United States Patent [19]

Kulgevich

[11] Patent Number: 4,604,985

[45] Date of Patent: Aug. 12, 1986

[54] FIRE ARM

[75] Inventor: Alexander Kulgevich, Brooklyn, N.Y.

[73] Assignee: Naum Frayberg, Brooklyn, N.Y.

[21] Appl. No.: 677,576

[22] Filed: Dec. 3, 1984

[51] Int. Cl.[4] ..... F41B 7/00; F41B 11/00

[52] U.S. Cl. ..... 124/56; 124/16; 124/44; 124/81

[58] Field of Search ..... 124/16, 44, 42, 81, 124/26–29, 56; 273/426

[56] References Cited

U.S. PATENT DOCUMENTS

| | | | |
|---|---|---|---|
| 477,747 | 6/1892 | Emerson | 124/16 X |
| 477,748 | 6/1892 | Emerson | 273/426 |
| 515,309 | 2/1894 | Vogel et al. | 124/44 X |
| 1,379,403 | 5/1921 | Green | 124/81 X |
| 1,399,537 | 12/1921 | Bayliss | 124/44 X |
| 2,469,016 | 5/1949 | Stopper | 124/16 X |
| 2,572,782 | 10/1951 | Vaaler et al. | 124/27 X |
| 3,403,909 | 10/1968 | Cleveland | 273/426 |

FOREIGN PATENT DOCUMENTS

| | | | |
|---|---|---|---|
| 411972 | 6/1910 | France | 273/426 |
| 935694 | 2/1948 | France | 124/27 |

*Primary Examiner*—Paul E. Shapiro

[57] ABSTRACT

A fire arm has a firing element provided with a muzzle and a mechanism to strike a boomerang, and a support attachable to the muzzle of the firing element and arranged to support the boomerang before firing. The strikes of different magnitudes are delivered to two legs of the boomerang by different length striker arms or different fluid pressures, and that provides spin to the boomerang.

4 Claims, 6 Drawing Figures

FIRE ARM

BACKGROUND OF THE INVENTION

The present invention relates to fire arms.

Many types of fire arms are known in the art and conventional include a firing element and elements to be fired. Nevertheless, there is a need of expanding a range of the existing fire arms. None of the known fire arms use boomerangs as elements to be fired, and therefore it would be advisable to have a fire arm which uses such an element to be fired.

SUMMARY OF THE INVENTION

Accordingly, it is an object of the present invention to provide a fire arm which is different from the existing fire arms.

In keeping with these objects and with others which will become apparent hereinafter, one feature of the present invention resides, briefly stated, in a fire arm which has a firing element provided with a muzzle and striking means, and at least one element to be fired and formed as a boomerang, wherein supporting means is provided on the muzzle of the firing element for supporting the boomerang before firing.

When the fire arm is designed in accordance with the present invention, for the first time it uses boomerangs as elements to be fired.

The novel features of the present invention are set forth in particularly in the appended claims; the invention itself will be best understood from the following description of preferred embodiments which is accompanied by the following drawings.

DESCRIPTION OF THE PREFERRED EMBODIMENTS

Figure 1:
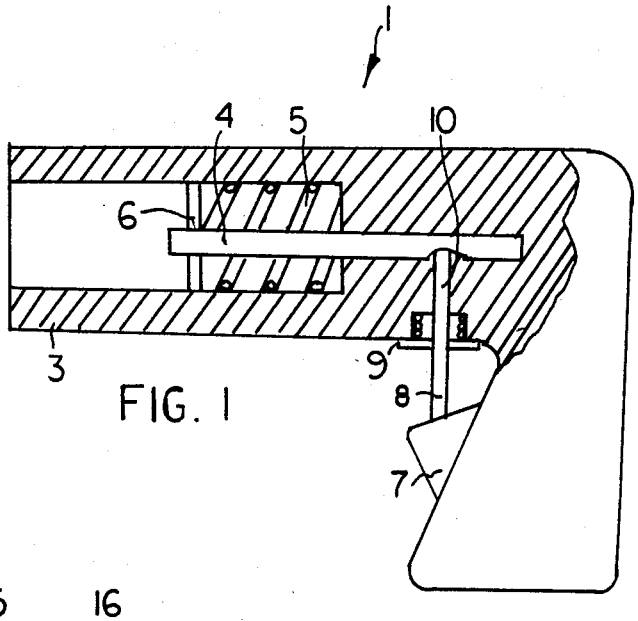
FIG. 1 is a view showing a fire arm in accordance with the present invention.

A fire arm in accordance with the present invention has a firing element which is identified in FIG. 1 with reference numeral 1 and is formed as a pistol. It is to be understood that the firing element can be formed also as a rifle, a gun, etc. The pistol shown in FIG. 1 has a handle 2 and a muzzle 3. A striker 4 is axially movable in the muzzle 3 under the action of a spring 5 connected by its one end on immovable part of the muzzle 3 and to its other end with a disk 6 attached to the striker 4. A cock 7 has a rod 8 which is biased by a spring 9 to engagement with a recess 10 in a rear end of the striker 4. The operation of the pistol 1 is believed to be evident. In an inoperative position the rod 8 engages the recess 10 and holds the striker 4. When a cock 7 is pulled by a user, the rod 8 is withdrawn from the recess 10 and the spring 5 urges the disk 6 and the striker 4 forwardly for striking.

Figure 2:
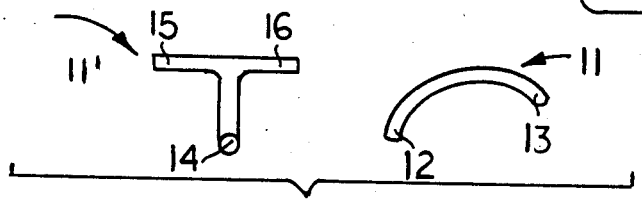
FIG. 2 is a view showing two types of elements to be fired with the inventive fire arm.
Figure 3:
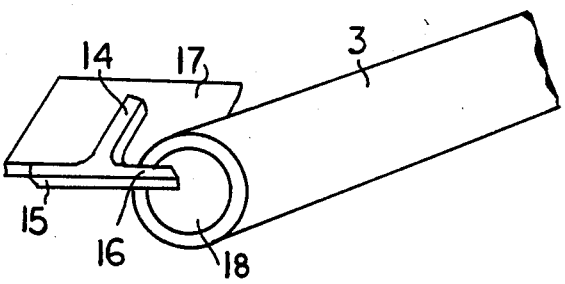
FIG. 3 is a view showing a support for the elements to be fired, in accordance with the present invention.

The element to be fired is formed as a boomerang 11 or 11' shown in FIG. 2. The boomerangs can be made of plastic, rubber, wood, they can be inflatable. They also can have a plurality of through going perforations so that during flying they produce whistling sounds. The boomerang 11 has two portions 12 and 13 connected therewith. The boomerang 11' has a central portion 14 and two sides portions 15 and 16 and is T-shaped. FIG. 3 shows a support 17 attached to the muzzle 3 of the pistol. The attachment can be performed in any manner, for example by welding to the muzzle or by making the support 7 of one piece with the muzzle. The support 17 is inclined at a certain angle, preferrably about 7°, to the longitudinal axis of the muzzle 3. The support 17 can be formed in correspondence with the shape of the boomerang. With the T-shaped boomerang, the support 17 is also T-shaped and is attached to the muzzle so that the central leg of the boomerang is located at the above-mentioned angle relative to the longitudinal axis of the muzzle 3, whereas the side leg 16 of the boomerang is located in front of an opening 18 of the muzzle 3. When the striker 4 delivers a strike against the side leg 16, the boomerang is fired and flies in a well known manner.

Figure 4:
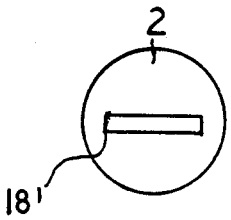
FIGS. 4 and 5 are views schematically showing a muzzle of a firing element of the inventive fire arm.
Figure 5:
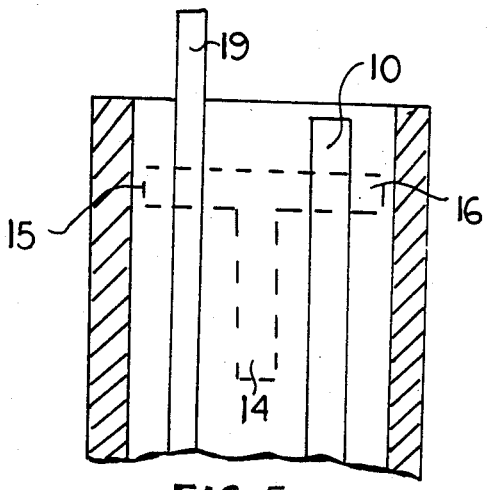

As can be seen from FIGS. 4 and 5 an opening 18' of the muzzle 3 can be formed as a narrow slot having a shape corresponding to the shape of the boomerang which is formed as a narrow strip. Only one striker can be of course provided in the pistol and movable so as to strike only one side leg of the boomerang. However, it is also possible to provide two strikers arranged so that they move in the muzzle 3 and act upon the side leg 15 and 16, respectively. In order to impart to the boomerang its characteristic movement, two strikers are moved so that a greater strike is delivered against the side leg 15 and a smaller strike is deliver against the side leg 16. This can be achieved by making the striker 19 longer than the striker 20 and acting on them simultaneously or connecting them with the same displacing member which is not shown in the drawing. When the displacing member is displaced under the action of the spring, the striker 15 is first to deliver the strike against the side leg 15, where upon the striker 20 delivers a strike against the side leg 16 imparting to the boomerang the respective flying movement.

Figure 6:
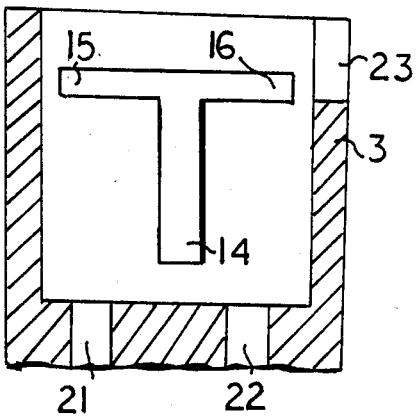
FIG. 6 is a view showing the muzzle of the inventive firing element in accordance with another embodiment of the invention.

The same principle of delivering strikes of different magnitudes can also be achieved in a pneumatic or hydraulic pistol shown in FIG. 6. Here the pistol is provided with identical passages 21 and 22 for supplying a firing medium, such as a compressed air or a liquid. The firing medium acts identically on both arms 15 and 16. However, an outlet portion of the muzzle 3 is provided with a slot 23 communicating the muzzle opening with the outside of the muzzle at the end of the displacement of the boomerang inside the muzzle. Therefore the side leg 15 is displaced inside the muzzle under the full action of the firing medium, whereas in the region of the side leg 16 the firing medium is relieved through the slot 23 at the end of the displacement of the side leg 16. Therefore the side leg 16 is subjected to a lower pressure from the firing medium, and again the known characteristic movement is imparted to the boomerang.

The invention is not limited to the details shown since various modifications and structural changes are possible without departing in any way from the spirit of the present invention.

What is desired to be protected by Letters Patent is set forth in particular in the appended claims.

I claim:

1. A fire arm, comprising a firing element having a muzzle and striking means; at least one element to be fired and formed as a boomerang, wherein said striking means is formed so as to deliver a stronger strike against one of said legs and a weaker against the other of said side legs of said boomerang.

2. A fire arm as defined in claim 1, wherein said striking means includes two strikers one of which is arranged to act upon said one side leg of said boomerang and is longer, whereas the other of said strikers is arranged to act upon said other side leg of said boomerang and is shorter.

3. A fire arm is defined in claim 1, wherein said striking means includes two passages through which a compressed medium is supplied for acting upon said side legs of said boomerang so as to apply a higher pressure on one of said side legs and a lower pressure on the other of said side legs of said boomerang.

4. A fire arm as defined in claim 3, wherein said striking means comprises said muzzle having a side slot arranged at a side corresponding to said other side leg of said boomerang, so that during firing the pressure of said medium is relieved through said slot and therefore said lower pressure is applied upon said other side leg of said boomerang.

* * * * *